United States Patent [19]

Raczkowski

[11] 4,024,591

[45] May 24, 1977

[54] COLLAPSIBLE BED MAKING DEVICE

[76] Inventor: Mark B. Raczkowski, 55C Bruan Place, Clifton, N.J. 07012

[22] Filed: Nov. 12, 1975

[21] Appl. No.: 631,229

[52] U.S. Cl. ..... 5/321
[51] Int. Cl.[2] ..... A47G 21/00
[58] Field of Search ..... 5/317, 321

[56] References Cited

UNITED STATES PATENTS

| | | | |
|---|---|---|---|
| 2,674,751 | 4/1954 | Kilpatrick | 5/321 |
| 3,855,655 | 12/1974 | Propst | 5/317 R |

*Primary Examiner*—Paul R. Gilliam
*Assistant Examiner*—Andrew M. Calvert

[57] ABSTRACT

In a collapsible bed making device, a pair of frame supports is affixed to the head side of a bed. A collapsible bed spread frame and a collapsible blanket frame are mounted pivotally on the frame supports. A bed spread is removably affixed to the collapsible bed spread frame. A blanket is removably affixed to the collapsible blanket frame. In order to prepare a bed, incorporating the bed making device of the invention for use, the bed spread frame with the bed spread is rotated upward more than 90° and left in that position. In order to prepare said bed for non-use, the blanket frame with the blanket is rotated upward and downward. Then the bed spread frame with the bed spread is rotated downward to a horizontal position.

4 Claims, 8 Drawing Figures

COLLAPSIBLE BED MAKING DEVICE

REFERENCES

U.S. Pat. No. 2,674,751; April, 1954; Kilpatrick; 5/321.
U.S. Pat. No. 3,855,655; December, 1974; Propst.

BACKGROUND OF THE INVENTION

The present invention relates to a bed making device. More particularly, the invention relates to a bed making device for a today's bed, having a mattress with a bed sheet on a box spring, the box spring being supported by a steel frame with bottom wheels. The bed may have a headboard, or not. The bed has spaced a head end, a foot end and a left side (looking from the foot end to the head end) and a right side.

The principal object of the invention is to provide a bed making device for semi-automatically making a bed for selectively dressing it for non-use and prepare it for use.

An object of the invention is to provide a bed making device of a simple, lightweight, collapsible structure, which is inexpensive in manufacture and functions to semi-automatically selectively dress a bed for non-use and prepare it for use.

Another object of this invention is to provide a bed making device of a simple structure, which is installed with facility and convenience on any today's bed and functions efficiently, effectively and reliably to selectively dress a bed for non-use and prepare it for use. Still another object of the invention is to provide a bed making device of simple structure, which is used by anyone, without the need for skill of any kind, with facility, convenience and rapidity, and functions to semi-automatically selectively dress a bed for non-use and prepare it for use. These and other objects and features of this invention will appear from the following description taken in conjunction with the accompanying drawings, in which:

PARTS LIST

Figure 1:
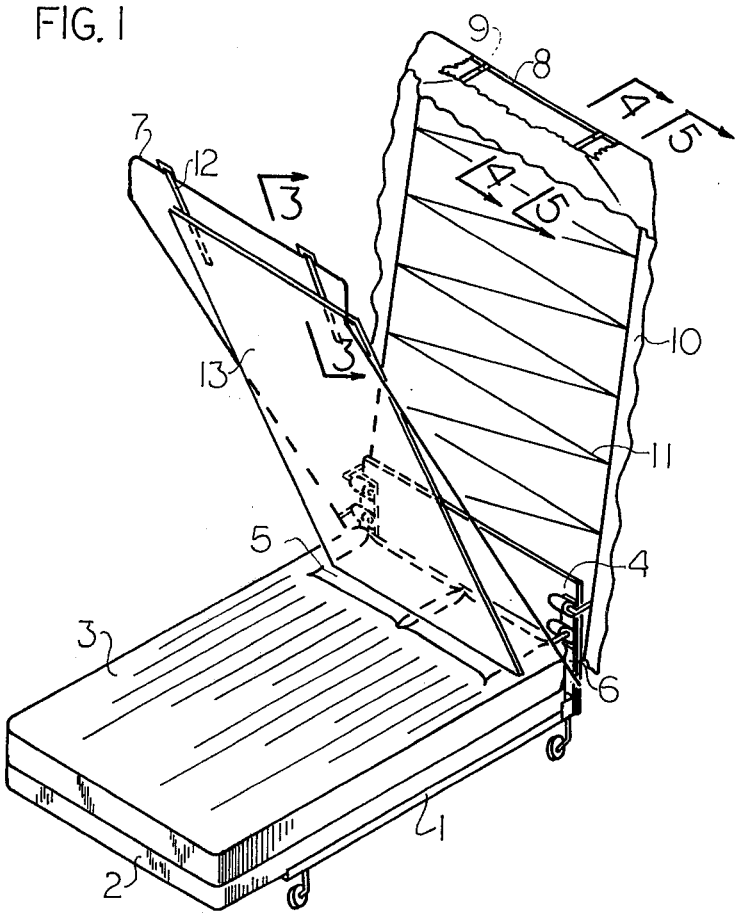
FIG. 1 is a perspective view of a bed incorporating the bed making device of the invention with a partially cutaway bed spread in preparing for non-use position.

1. Steel frame
2. Box spring
3. Mattress with bed sheet
4. Headboard
5. Pillow
6. Frame support
7. Collapsible blanket frame
8. Collapsible bed spread frame
9. Separation spring
10. Bed spread
11. Support rope
12. Blanket strip
13. Blanket
14. Safety pin
15. Bed spread strip
16. Snap fastener
17. Pivot bearing
18. Bed spread hanger
19. Upper left rod
20. Upper right rod
21. Upper left axle
22. Upper right axle
23. Blanket hanger
24. Left rod
25. Right rod
26. Lower left axle
27. Lower right axle
28. Catch
29. Counterweight
30. Washer
31. Pin
32. Through hole
33. Dowel
34. Socket
35. Springing frame support
36. Upper left arm
37. Upper right arm
38. Left arm
39. Right arm
40. Springing pivot bearing
41. Counterbalance spring
42. Bag for small parts

DESCRIPTION OF THE PREFERRED EMBODIMENT

Figure 3:
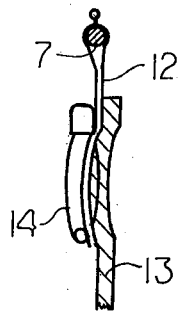
FIG. 3 is an enlarged part sectional view of FIG. 1 at line 3—3; showing the blanket - blanket frame assembly.

Referring to the drawings in detail FIG. 1 illustrates a bed incorporating the bed making device of the invention in preparing for non-use position. A mattress with a bed sheet 3 on a box spring 2 are supported by a steel frame 1. Frame supports 6 are mounted to the steel frame 1 by using the same through members in affixing the headboard 4 to said steel frame. Pillows 5 are lying on the bed. A collapsible blanket frame 7 is mounted pivotally in lower pivot bearings of the frame supports 6. A blanket 13 is removably affixed to the blanket frame 7 by using blanket strips 12 and safety pins 14 (FIG. 3).

Figure 4:
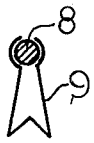
FIG. 4 is an enlarged part sectional view of FIG. 1 at line 4—4; showing the separat on spring - bed spread frame assembly.
Figure 5:
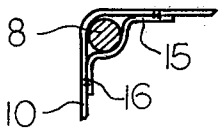
FIG. 5 is an enlarged part sectional view of FIG. 1 at line 5—5; showing the bed spread - bed spread frame assembly.
Figure 2:
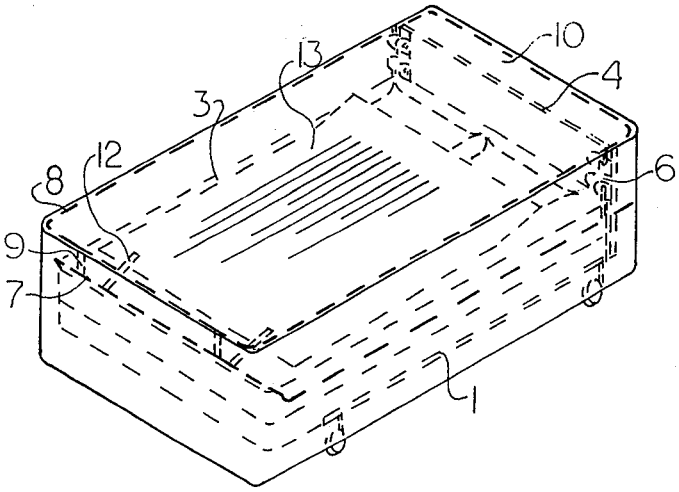
FIG. 2 is a perspective view of the bed of FIG. 1 in non-use position.

A collapsible bed spread frame 8 is mounted pivotally in upper pivot bearings of the frame supports 6. A bed spread 10 with snap fasteners 16 is removably affixed to the collapsible bed spread frame 8 by using bed spread strips 15 (FIG. 5). A support rope 11 is connected to through holes in the collapsible bed spread frame 8. The support rope 11 keeps the bed spread 10 from losing its shape in the non-use position. A separation spring 9 is removably affixed to the collapsible bed spread frame 8 (FIG. 2 and FIG. 4). It supports said frame 8 in a horizontal position in the non-use state (FIG. 2).

FIG. 2 illustrates the bed incorporating the bed making device of the invention in non-use position. The collapsible blanket frame 7 with the blanket 13 remains on the mattress 3 in the horizontal position. The collapsible bed spread frame 8 with the bed spread 10, supported by the separation spring 9, remains in the horizontal position. The bed spread 10 covers the entire bed- bed making device assembly.

In order to prepare the bed for use, the collapsible bed spread frame 8 with the bed spread 10 is rotated more than 90° and left in that position (FIG. 1). In order to prepare the bed for non-use, the collapsible blanket frame 7 with the blanket 13 is rotated upward (FIG. 1) and rapidly rotated downward. The air resistance helps to stretch the blanket. Then the collapsible bed spread frame 8 with the bed spread 10 is rotated downward to a horizontal position and the bed is set in the non-use position (FIG. 2).

Figure 6:
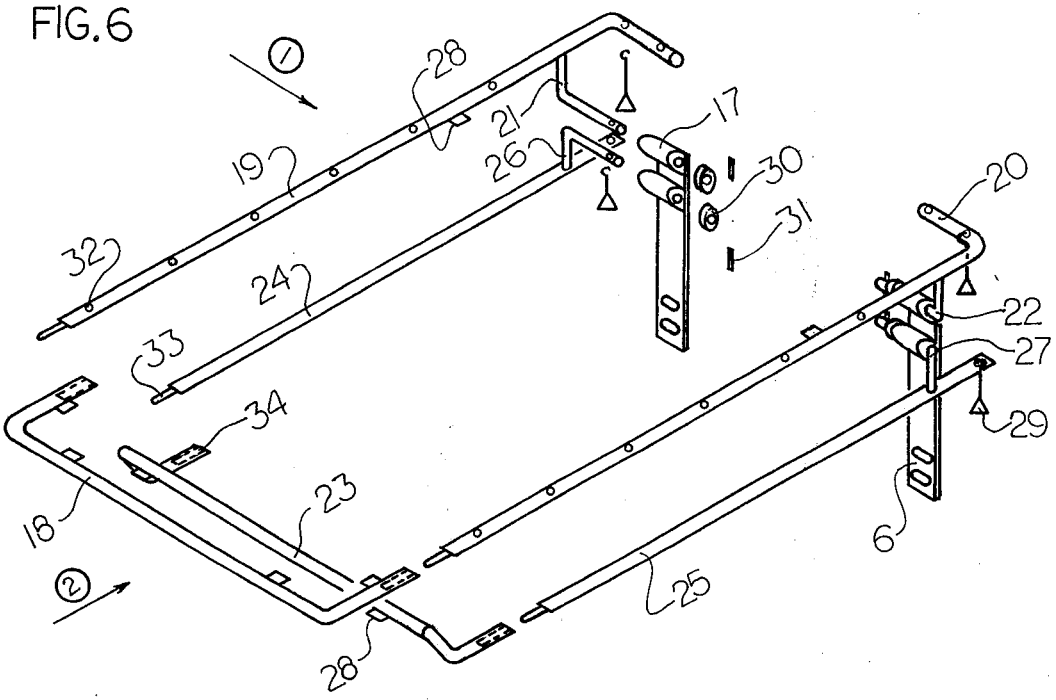
FIG. 6 is a perspective view of the collapsible bed spread frame, the collapsible blanket frame and the frame supports during assembly.

FIG. 6 illustrates details of the collapsible bed spread frame, the collapsible blanket frame and the frame supports during assembly. On the left and bottom side of the drawing the parts are disassembled, on the right side some parts are already assembled. In the above are shown parts of the collapsible bed spread frame 8:

An upper left rod 19 with catches 28, through holes 32 with an upper left axle 21 and with end dowel 33;

An upper right rod 20 with catches 28, through holes 32 with an upper right axle 22 and with end dowel 33;

A bed spread hanger 18 with catches 28 and with end sockets 34.

To the collapsible blanket frame belong:

A left rod 24 with a through hole 32, a lower left axle 26 and with end dowel 33;

A right rod 25 with a through hole 32, an upper right axle 27 and with end dowel 33;

A blanket hanger 23 with catches 28 and with end sockets 34.

Referring to FIG. 6 there are also:

Frame supports 6 with bottom slotted openings and pivot bearings 17 in upper part of the supports;

Counterweights 29;

Washers 30;

Pins 31.

In order to assemble the parts shown on FIG. 1, the supports 6 are mounted to the steel frame 1 by using the same through members in affixing the headboard 4 to said steel frame. The side rods 24; 25; 19 and 20 are mounted pivotaly in the pivot bearings 17 of the supports 6. The washers 30 are mounted on the axles 26; 21; 27 and 22. The pins 31 are forced through the axle holes. Now the blanket hanger 23 is assembled with rods 24 and 25 by locating their dowels 33 in the sockets 34 of the hanger. The bed spread hanger 18 is assembled in the same manner with the rods 19 and 20.

Then the counterweights 29 are hung and the device is ready for assemblying the support rope 11, the separation spring member 9 and bed clothes as shown on FIG. 1 thru FIG. 5.

Circled numbers ① and ② on FIG. 6 indicate the sequence of assembly.

Figure 7:
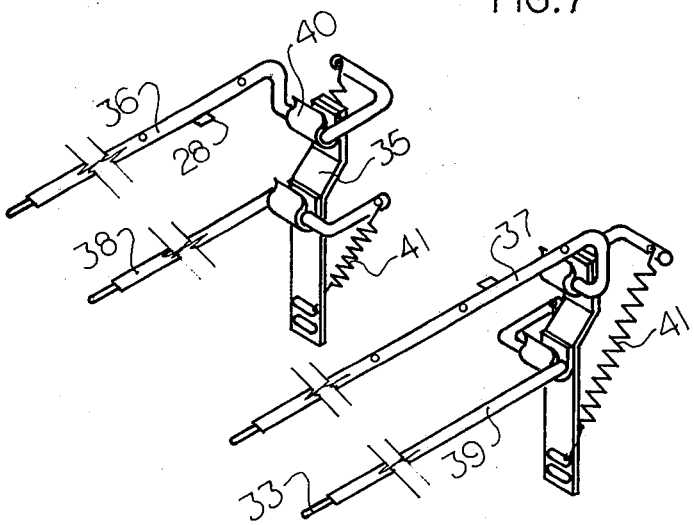
FIG. 7 is a perspective view of the head part of the collapsible bed spread frame, the collapsible blanket frame and the springing frame supports in non- use position.

FIG. 7 illustrates the head part of another version of the collapsible frames - frame support assembly for a no headboard bed. The upper left arm 36; an upper right arm 37; a left arm 38 and a right arm 39 are similar to the upper rods 19; 20 and to the rods 24 and 25 with no axles and with differently shaped head parts. Springing frame supports 35 have open spring pivot bearings 40 in their upper parts. There are also counter balance springs 41. Assembly of this version of the bed making device is even easier than the version of FIG. 6, because sequence of assembling the collapsible frames is not important as the pivot bearings 40 are open from the top.

Figure 8:
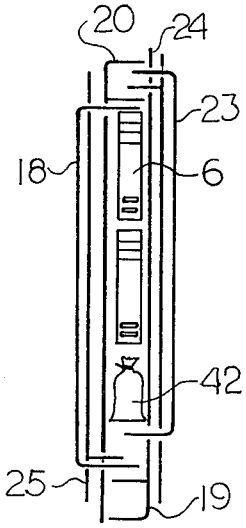
FIG. 8 is a top view of the parts of the collapsible bed spread frame, the collapsible blanket frame, and the frame supports in a storage position.

FIG. 8 illustrates the bed making device of the invention in the non assembly position. There is a bag 42 for small parts such as counterweights 29; washers 30; pins 31 etc.

The frame supports 6 may be affixed to any bed with a steel support or a wooden frame, or to any side of the headboard.

The bed making device of the invention may be readly built in miniature and mounted in a miniature bed and thereby function as a toy.

While the invention has been described by means of specific examples and in specific embodiments, I do not wish to be limited thereto, for obvious modifications will occur to those skilled in the art without departing from the spirit and scope of the invention.

I claim:

1. A collapsible bed making device for a bed having a bed frame supporting a mattress and comprising:

a supporting structure affixed to the bed frame at one end thereof;

a collapsible blanket frame including a pair of side rods, each of said side rods having a dowel at one end thereof, and a generally U-shaped blanket hanger with the bight of the U being raised with respect to the legs thereof and having a socket at the end of each leg of the U to receive said dowels, said blanket frame being easily assembled and disassembled by separating said blanket hanger from said side rods;

a first pair of pivot mountings on said supporting structure;

disengageable pivot means located adjacent the ends of said side rods of said blanket frame opposite said dowels, said pivot means each releasably engaging a corresponding one of said first pair of pivot mountings;

a collapsible bed spread frame including a pair of side rods, each of said side rods having a dowel at a first end thereof, and a U-shaped bed spread hanger having a socket at the end of each leg of the U to receive said dowels, said bed spread frame being easily assembled and disassembled by separating said bed spread hanger from said side rods;

a second pair of pivot mountings located on said supporting structure above said first pair of pivot mountings;

disengageable pivot means located adjacent the ends of said side rods of said bed spread frame opposite said dowels, said pivot means each releasably engaging a corresponding one of said second pair of pivot mountings;

a stop arm located adjacent the end of each of said side rods of said bed spread frame nearest said pivot means to limit the motion of and to support said bed spread frame after it has been rotated a predetermined amount in excess of 90° from the plane of the mattress;

first fastening means to secure an end of a blanket to said blanket hanger;

second fastening means to secure a bed spread to said bed spread frame;

first bias means opposing the force toward the mattress produced on said blanket frame by the weight thereof;

second bias means opposing the force toward the mattress produced on said bed spread frame by the weight thereof; and a pair of separation springs removably affixed to said bed spread hanger to support said bed spread frame parallel to the plane of the mattress when the bed is not in use.

2. A collapsible bed making device as claimed in claim 1 and further comprising a support rope interwoven between said side rods of said bed spread frame to maintain the shape of said bed spread when said bed spread frame is located parallel to the plane of the mattress during the time that the bed is not in use.

3. A collapsible bed making device as claimed in claim 1 wherein:

said pivot mountings comprise cylindrical pivot bearings secured to said supporting structure;

said pivot means comprise L-shaped axles with a leg of each axle extending through an associated one of said cylindrical pivot bearings;

a pin is passed through an opening adjacent the end of each axle leg extending through a pivot bearing to preclude the axle from being withdrawn from its associated pivot bearing; and said bias means comprise counterweights located on said side rods on the side of said pivot means removed from the greatest extent of said side rods.

4. A collapsible bed making device as claimed in claim 1 wherein:

said pivot mountings comprise generally C-shaped pivot bearings secured to said supporting structure with the open portion of the C positioned upwardly;

said pivot means comprise portions of said side rods extending transversely to the main length of said side rods and adapted to releasably fit in said pivot bearings; and said bias means comprise springs extending from a portion of said side rods located on the side of said pivot means removed from the greatest extent of said side rods to said supporting structure.

* * * * *